US009463346B1

(12) United States Patent
Farmen

(10) Patent No.: US 9,463,346 B1
(45) Date of Patent: Oct. 11, 2016

(54) EXTERNAL ROTATOR MUSCLES TRAINING DEVICE

(71) Applicant: Derek Farmen, Port Orange, FL (US)

(72) Inventor: Derek Farmen, Port Orange, FL (US)

( * ) Notice: Subject to any disclaimer, the term of this patent is extended or adjusted under 35 U.S.C. 154(b) by 0 days.

(21) Appl. No.: 14/696,577

(22) Filed: Apr. 27, 2015

(51) Int. Cl.

| | |
|---|---|
| ***A63B 23/16*** | (2006.01) |
| ***A63B 21/06*** | (2006.01) |
| ***A63B 21/08*** | (2006.01) |
| ***A63B 21/072*** | (2006.01) |
| ***A63B 21/075*** | (2006.01) |
| ***A63B 21/002*** | (2006.01) |

(Continued)

(52) U.S. Cl.

CPC ..... *A63B 21/0023* (2013.01); *A63B 43/02* (2013.01); *A63B 65/122* (2013.01); *A63B 21/0004* (2013.01); *A63B 21/06* (2013.01); *A63B 21/065* (2013.01); *A63B 21/08* (2013.01); *A63B 21/4017* (2015.10); *A63B 21/4019* (2015.10); *A63B 21/4033* (2015.10); *A63B 21/4035* (2015.10); *A63B 21/4043* (2015.10); *A63B 23/1245* (2013.01); *A63B 47/001* (2013.01); *A63B 59/20* (2015.10); *A63B 69/0002* (2013.01); *A63B 2069/0006* (2013.01)

(58) Field of Classification Search

CPC ..... A63B 21/0004; A63B 21/0023; A63B 21/06; A63B 21/0601–21/0609; A63B 21/0615; A63B 21/0616; A63B 21/0617; A63B 21/065; A63B 21/072; A63B 21/08; A63B 21/0726; A63B 21/4017; A63B 21/4019; A63B 21/4021; A63B 21/4023; A63B 21/4027; A63B 21/4033; A63B 21/4035; A63B 21/4041; A63B 21/4043; A63B 21/4047; A63B 21/4049; A63B 23/1245; A63B 23/1254; A63B 23/1263; A63B 23/1272; A63B 2069/0004; A63B 2069/0006; A63B 69/0002; A63B 2102/18; A63B 2244/14; A63B 2244/15; A63B 2244/17; A63B 43/02; A63B 47/00; A63B 47/001; A63B 47/002; A63B 47/007; A63B 47/02; A63B 59/20; A63B 65/06; A63B 65/12; A63B 65/122; A47F 5/0037; A47F 7/28; A45F 2005/008; A45F 2200/0583; B25G 3/38; B62B 1/04; B62B 2202/028; A61H 1/0281; B65D 23/108

USPC ..... 206/162; 220/741, 752, 756–759, 220/762–766

See application file for complete search history.

(56) References Cited

U.S. PATENT DOCUMENTS 1,866,158 A * 7/1932 Goodwin ..... A63B 59/20 124/5

4,995,526 A * 2/1991 Garrison ..... A47L 13/58 15/264

(Continued)

*Primary Examiner* — Oren Ginsberg
*Assistant Examiner* — Joshua Lee
(74) *Attorney, Agent, or Firm* — Dale J. Ream

(57) ABSTRACT

An external rotator muscles training device for use with a training ball to strengthen external rotator muscles of a person's shoulder includes a frame assembly having a pair of elongate frame members parallel to one another, each frame member having opposed proximal and distal ends. A receptacle has a closed bottom and a side wall extending upwardly from the closed bottom, the side wall defining an open top allowing access to an interior area defined by the closed bottom and the side wall. The receptacle is coupled to the distal ends of the pair of frame members and positioned in a primary position in which the open top is generally perpendicular to a plane defined by the pair of frame member. A handle member extends between the pair of frame members, the handle member being situated between the receptacle and the proximal ends of the pair of frame members.

16 Claims, 9 Drawing Sheets

(51) Int. Cl.

| | |
|---|---|
| ***A63B 43/02*** | (2006.01) |
| ***A63B 65/12*** | (2006.01) |
| *A63B 21/00* | (2006.01) |
| *A63B 21/065* | (2006.01) |
| *A63B 23/12* | (2006.01) |
| *A63B 47/00* | (2006.01) |
| *A63B 69/00* | (2006.01) |

(56) References Cited

U.S. PATENT DOCUMENTS 5,110,119 A * 5/1992 Arnold ..... A63B 21/4017 482/108
5,158,517 A 10/1992 Steggert
5,271,617 A * 12/1993 Gilford ..... A63B 23/14 473/450
5,417,643 A 5/1995 Taylor
5,445,425 A * 8/1995 Lyver ..... B65D 25/32 220/760
5,484,081 A * 1/1996 Jahn ..... A47G 23/0266 220/483
5,558,624 A 9/1996 Hepburn et al.
5,582,402 A * 12/1996 Gilford ..... A63B 21/055 473/450
5,709,637 A 1/1998 Gow et al.
5,738,616 A 4/1998 Robertson
5,774,937 A * 7/1998 Caminos ..... A47J 45/061 16/425
5,938,547 A * 8/1999 Gilford ..... A63B 69/0071 473/450
6,001,049 A * 12/1999 Frey ..... A63B 21/0603 482/105
6,007,500 A 12/1999 Quintinskie, Jr.
6,698,064 B1 * 3/2004 Graj ..... A47J 45/071 16/422
6,715,728 B2 * 4/2004 Nielsen ..... A63B 21/4009 224/268
6,837,502 B1 * 1/2005 Lee ..... B62B 1/125 280/47.24
6,884,187 B2 4/2005 Cataldi, Jr. et al.
D509,034 S * 8/2005 Morelock ..... D32/53.1
7,255,658 B1 * 8/2007 VanKuiken ..... A63B 69/0002 473/417
7,329,212 B2 * 2/2008 Roque ..... A63B 15/00 482/110
7,431,313 B1 * 10/2008 Torres ..... B25H 3/00 280/124.12
7,438,300 B1 * 10/2008 Zien ..... B62B 1/14 280/47.26
7,445,569 B2 * 11/2008 Comello, Jr. ..... A63B 23/1281 473/422
7,621,857 B2 11/2009 Pompile
7,699,724 B1 4/2010 Derisse
7,946,967 B2 * 5/2011 Berhanu ..... A63B 21/072 482/109
D640,287 S * 6/2011 Dubois ..... D15/10
8,016,118 B2 * 9/2011 Boll ..... B07B 1/02 209/417
2007/0135275 A1 6/2007 Oates
2008/0051270 A1 * 2/2008 Lazar ..... A63B 21/06 482/105
2010/0225077 A1 * 9/2010 Plesh ..... B62B 1/12 280/47.23
2011/0210572 A1 * 9/2011 Rockwell ..... E01H 5/02 294/54.5
2011/0314639 A1 * 12/2011 Herigstad ..... A47J 45/06 16/421
2012/0101419 A1 4/2012 Bonutti et al.
2012/0309567 A1 12/2012 Skinner
2016/0114237 A1 * 4/2016 Garcia, Jr. ..... A63B 71/0036 206/315.1

* cited by examiner

EXTERNAL ROTATOR MUSCLES TRAINING DEVICE

BACKGROUND OF THE INVENTION

This invention relates generally to muscle training and therapeutic equipment and, more particularly, to a training device to train and strengthen the external rotator muscles of a person's shoulder. Use of the present invention directly stimulates the stretch shortening cycle in the external rotators to allow for more motor unit recruitment after a rapid stretching of the external rotators, further increasing the benefits of rotational exercise.

Athletes, as well as other individuals, who experience repetitive rotational stress on the shoulder(s) are benefitted by exercises that stretch and strengthen rotational muscles of the shoulder. The external rotator muscles of the shoulder (Supraspinatus, Infraspinatus, and Teres Minor) are prone to injury. For instance, baseball pitchers often experience fatigue or injury to the rotator cuff of a shoulder due to stresses placed on external and internal rotators. The lack of flexibility and muscular balance of muscles in the shoulder often leads to injury.

Various devices have been used in the past to stretch or train shoulder muscles. For instance, kettle bells and dumbbells use gravity to apply force upon shoulder muscles. These devices and corresponding methods use gravity to apply force but do not provide stress upon the external rotators at the shoulder until rotation has started. Unfortunately, this does not properly replicate the stresses experienced with the rotational motions associated with certain activities, such as pitching.

Therefore, it would be desirable to have a training device to train the external rotator muscles of the shoulder in both eccentric (produces force as the muscle lengthens) and concentric (produces force as the muscle shortens) muscle actions. Further, it would be desirable to have a training device that directly stimulates the stretch shortening cycle of the external rotators to allow for more motor unit recruitment after a rapid stretching of the external rotators, further strengthening the muscles stimulated.

SUMMARY OF THE INVENTION

An external rotator muscles training device for use with a training ball to strengthen the external rotator muscles of a person's shoulder according to the present invention includes a frame assembly having a pair of elongate frame members displaced from and parallel to one another, each frame member having opposed proximal and distal ends. A receptacle has a closed bottom and a side wall extending upwardly from the closed bottom, the side wall defining an open top allowing access to an interior area defined by the closed bottom and the side wall. The receptacle is coupled to the distal ends of the pair of frame members and positioned in a primary position in which the open top is generally perpendicular to a plane defined by the pair of frame member. A handle member extends between the pair of frame members, the handle member being situated between the receptacle and the proximal ends of the pair of frame members.

Therefore, a general object of this invention is to provide an external rotator muscles training device to train and strengthen the external rotator muscles of a person's shoulder.

Another object of this invention is to provide an external rotator muscles training device, as aforesaid, that stimulates the stretch shortening cycle of the external rotators to allow for more motor unit recruitment after a rapid stretching of the external rotators Still another object of this invention is to provide an external rotator muscles training device, as aforesaid, having a receptacle designed to receive a weighted ball, the reception of which uses momentum to create torque, rather than gravity, that stimulates external rotators immediately and through a full range of motion.

Yet another object of this invention is to provide an external rotator muscles training device, as aforesaid, having a handle that may be grasped by a user and oriented vertically and then moved through a range of motion resulting from receiving the weighted ball and then reversing the motion caused by said reception.

A further object of this invention is to provide an external rotator muscles training device, as aforesaid, that is length adjustable for use by persons having different arm lengths.

A still further object of this invention is to provide an external rotator muscles training device, as aforesaid, in which the receptacle is rotatably positioned to accommodate users of different heights and/or different ranges of motion.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
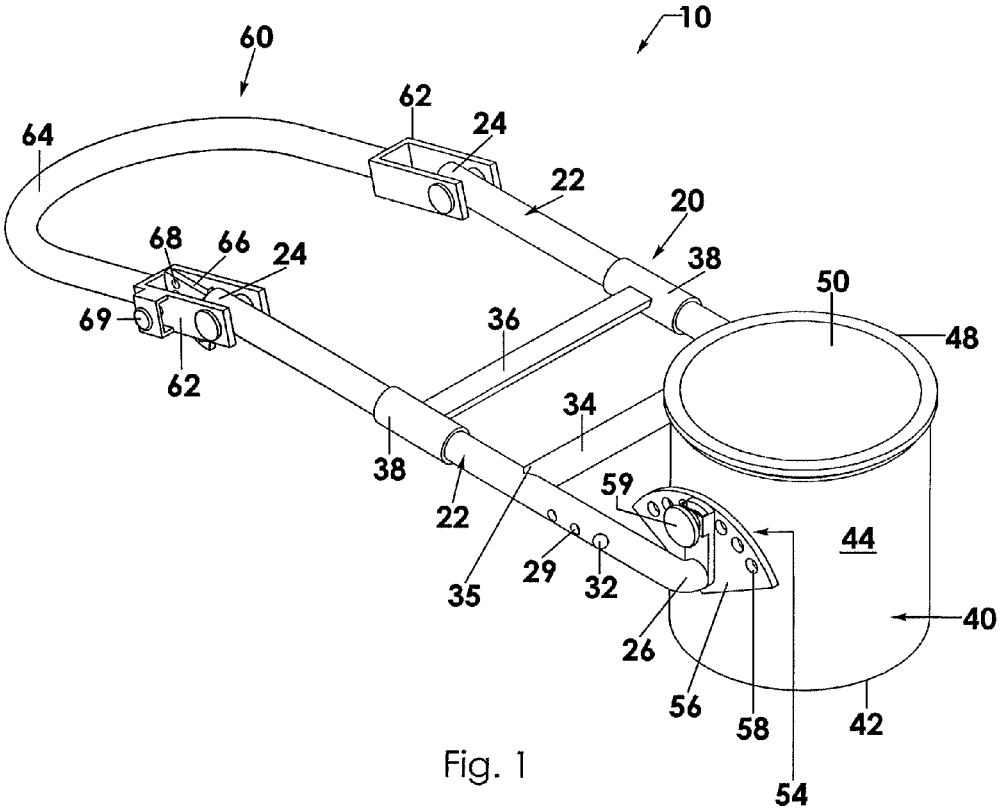
FIG. 1 is a perspective view of an external rotator muscles training device according to a preferred embodiment of the present invention, illustrated with a support arm assembly at an offset configuration and a handle member and support arm at a retracted or shortened configuration.

An external rotator muscles training device for use with a medicine ball during an exercise method or therapy to strengthen and train external rotator muscles of a person's shoulder according to a preferred embodiment of the present invention will now be described in detail with reference to FIGS. 1 to 9 of the accompanying drawings. The external rotator muscles training device 10 includes a frame assembly 20, a receptacle 40 configured to receive a training ball 8, a support arm 36, and support structures configured to enable a person to use the device in various exercises to strengthen specific shoulder muscles.

The frame assembly 20 includes a pair of elongate frame members 22 being displaced from and parallel to one another, each frame member 22 having a generally linear configuration (FIG. 1). Preferably, each frame member 22 has a tubular configuration and may include multiple sections that are length adjustable as will be described later. Each frame member 22 includes a proximal end 24 and an opposed distal end 26.

The frame assembly 20 includes a handle member 34 having a linear configuration and opposed ends 35 extending between frame members 22. Preferably, the handle member 34 is situated between the receptacle 40 and proximal ends 24 of the frame members 22 and preferably is proximate the receptacle 40. The handle member 34 may have a padded construction as a user will grasp the handle member 34 in use as will be described more fully later.

Further, the frame assembly 20 includes a support arm 36 having opposed ends 38 slidably coupled to respective frame members 22 in a friction fit arrangement. The support arm 36, therefore, is slidably movable along the frame members 22 to be either closer to the handle member 34 or further away from the handle member 34. In use, the support arm 36 is movable and configured to provide support to a user's wrist or forearm area while grasping the handle member 34 with his hand. The support arm 36 may be constructed of a flexible or padded material. Preferably, the user slips his hand and wrist beneath the support arm 36 before grasping the handle member 34.

Figure 2:
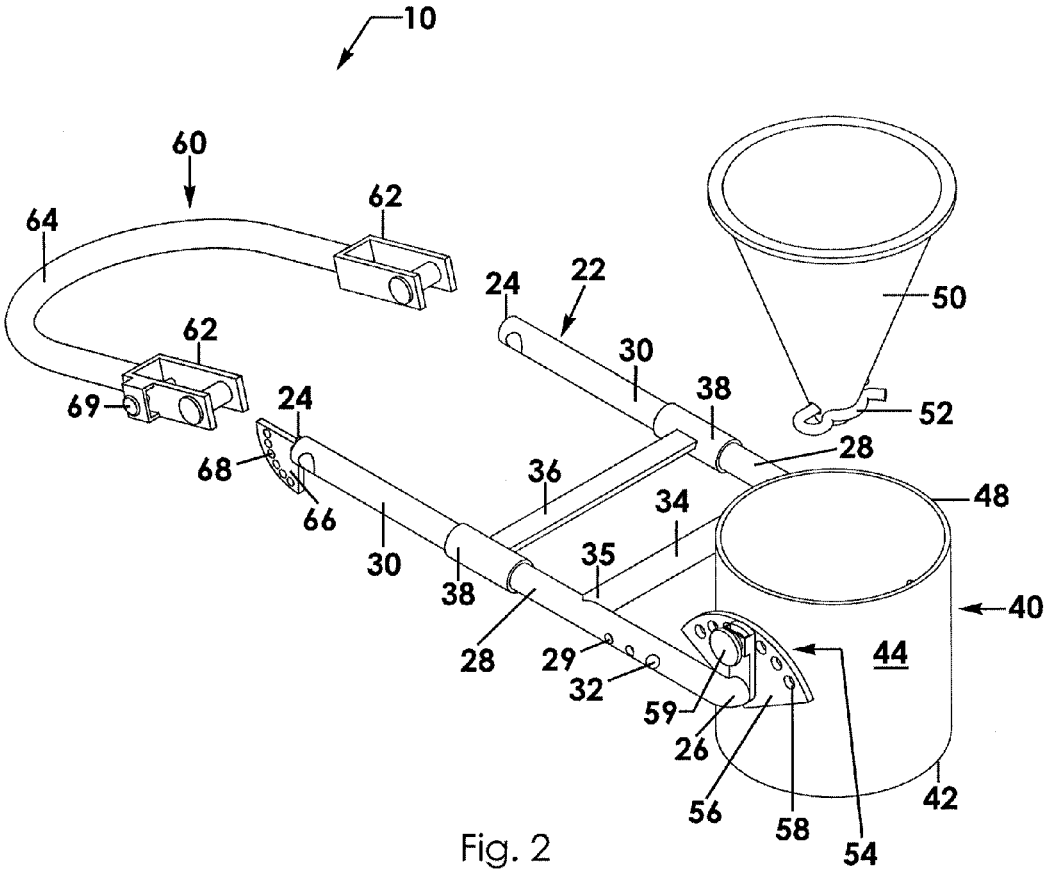
FIG. 2 is an exploded view of the training device as in FIG. 1.
Figure 3:
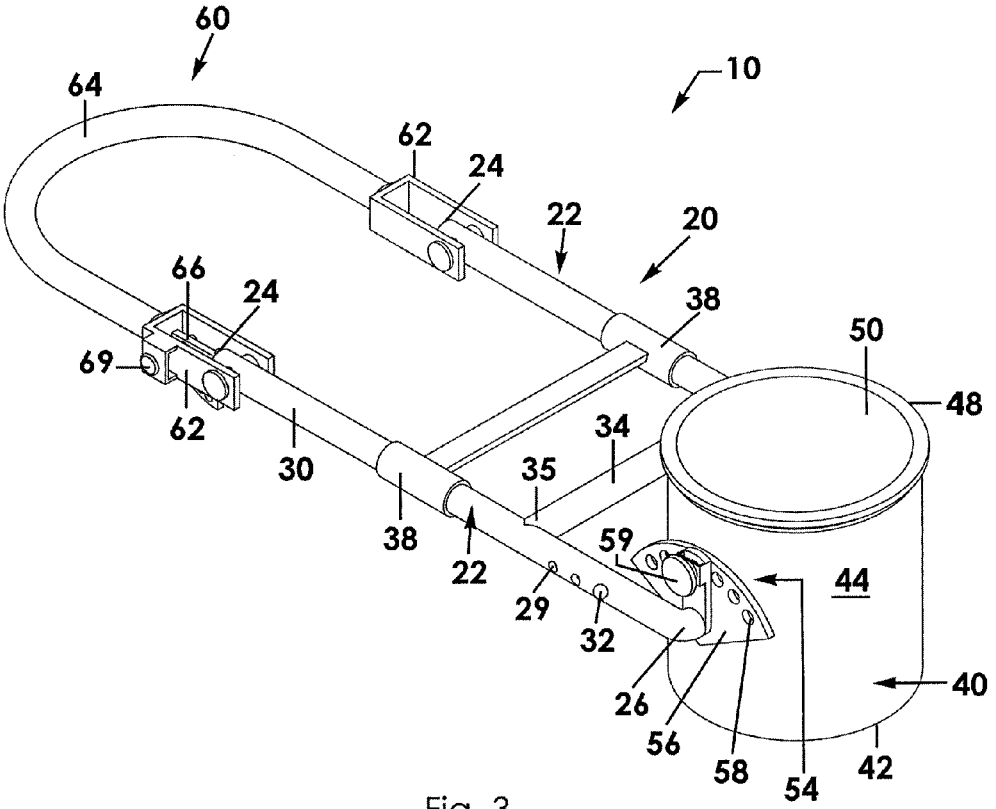
FIG. 3 is another perspective view of the training device as in FIG. 1 illustrated with the support arm assembly in a configuration generally planar with corresponding frame members.
Figure 4:
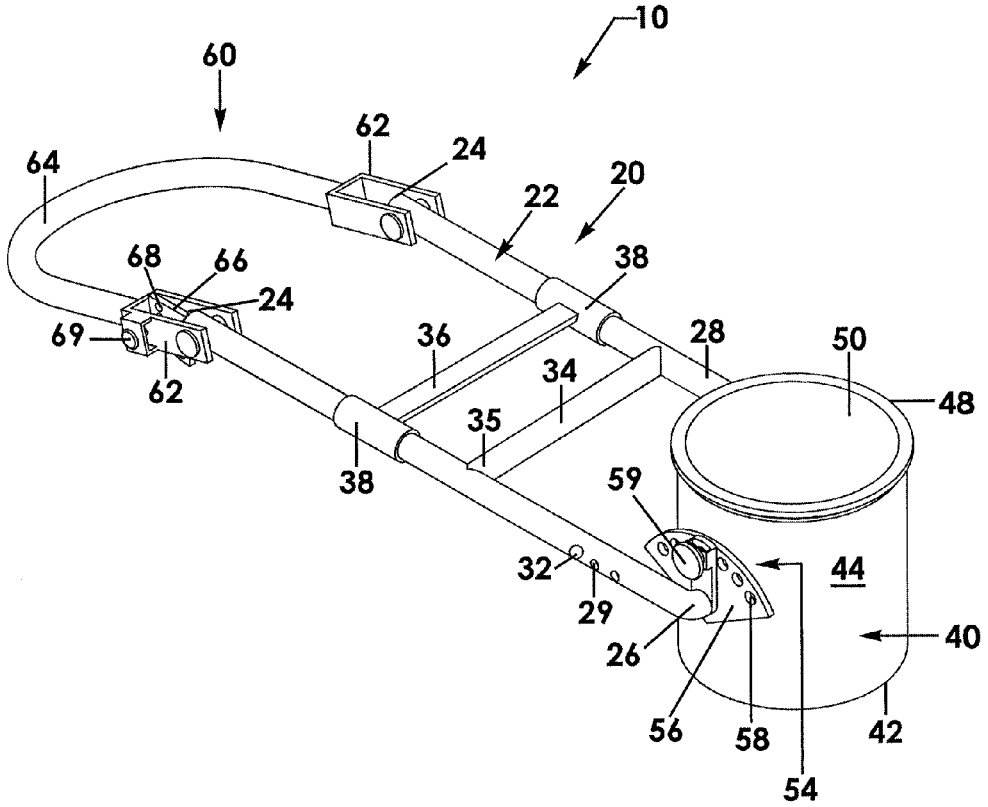
FIG. 4 is another perspective view of the training device as in FIG. 1 illustrated with the handle positioned at an extended length configuration.

The receptacle 40 includes a bottom wall 42 and a side wall 44 extending upwardly from peripheral edges of the bottom wall 42. Preferably, the side wall is a continuous side wall 44—meaning that the side wall 44 has a cylindrical configuration although multiple upstanding side walls arranged in square, rectangular, conical, or other configuration would also work. Together, the bottom wall 42 and side wall 44 define an interior area 46 (FIG. 2). Upper edges of the side wall 44 define an open top 48 that provides access to the interior area 46.

In an embodiment, the training device 10 includes a receiving member 50 positioned in the interior area 46 of the receptacle 40. Preferably, the receiving member 50 includes a conical configuration that more effectively receives a training ball 8 than the cylindrical configuration of the side wall 44 of the receptacle 40. More particularly, the receiving member 50 includes an upper edge or rim having a diameter substantially similar or the same as a diameter of the open top 48 of the receptacle 40. The receiving member 50, then, has a conical shaped side wall 44 that extends downwardly from the upper edge thereof to an apex or generally pointed or truncated lower end (FIG. 2).

The receiving member 50 may include a fastener 52, such as a cotter pin or the like, configured to selectively couple the lower end of the receiving member 50 to the bottom wall 42 of the receptacle 40 (FIG. 2). It is understood that the conical shape of the receiving member 50 is better suited to capture and secure a round training ball 8, such as a medicine ball, than the cylindrically shaped receptacle 40 and is also better able to eject the training ball 8 from the receptacle 40 when the training device 10 is manipulated in a throwing motion, as will be described in more detail later.

The receptacle 40 is coupled to respective distal end 26 of the pair of frame members 22. Preferably, the receptacle 40 is maintained in an orientation in which the open top 48 is perpendicular to the frame members 22. Specifically, the frame members 22 define a geometric plane. Therefore, the open top 48 has a primary position that is perpendicular to the plane defined by the frame members 22. The primary position orients the receptacle 40 on its side with the open top 48 directed rearward when the frame assembly 20 is positioned upright and ready for a training regimen as will be described later.

Figure 5:
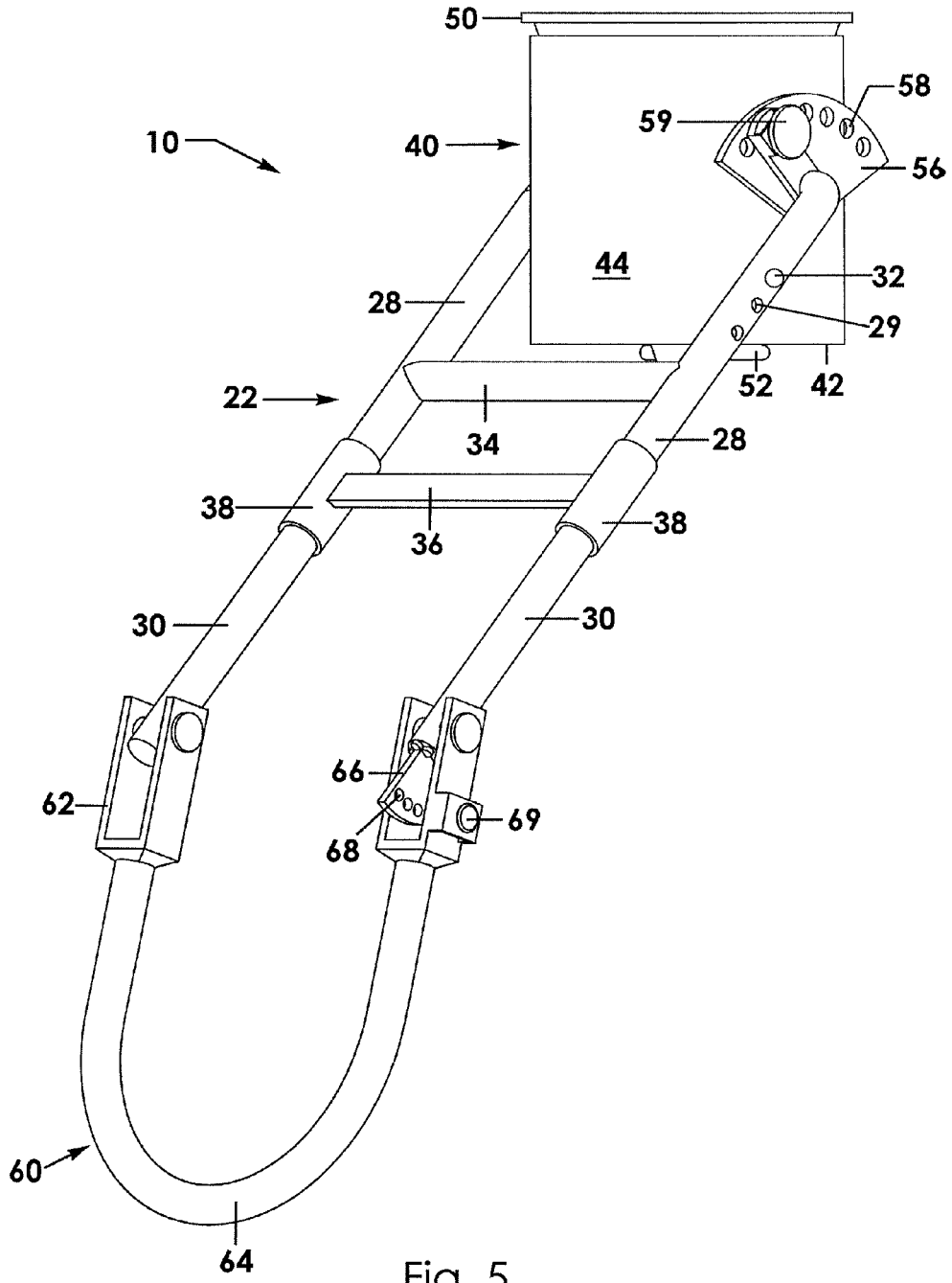
FIG. 5 is another perspective view of the training device as in FIG. 1 illustrated with the support arm assembly rotatably offset and the receptacle rotated in a first direction.
Figure 6:
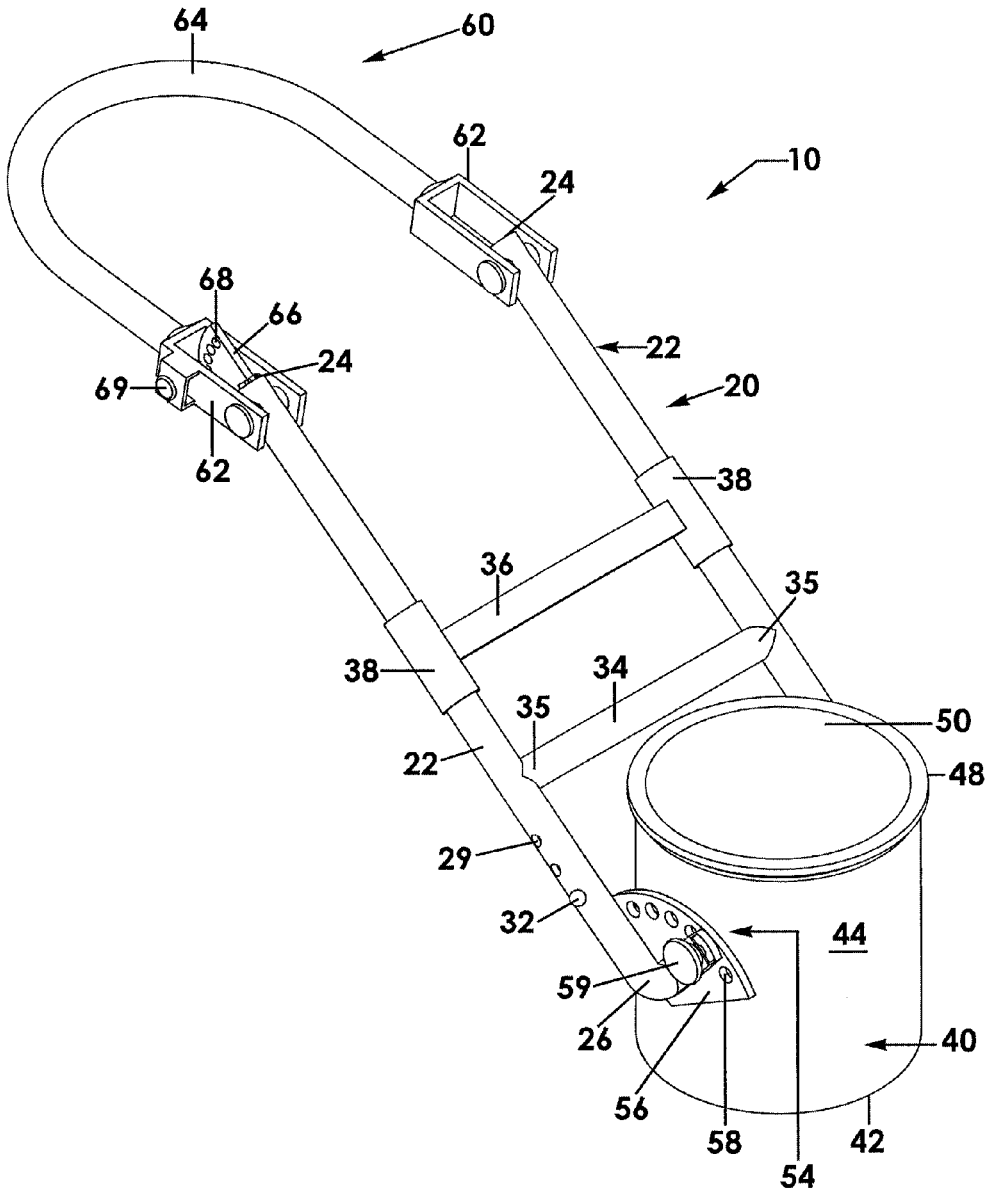
FIG. 6 is another perspective view of the training device as in FIG. 5 illustrated with the receptacle rotated in a second direction.
Figure 7:
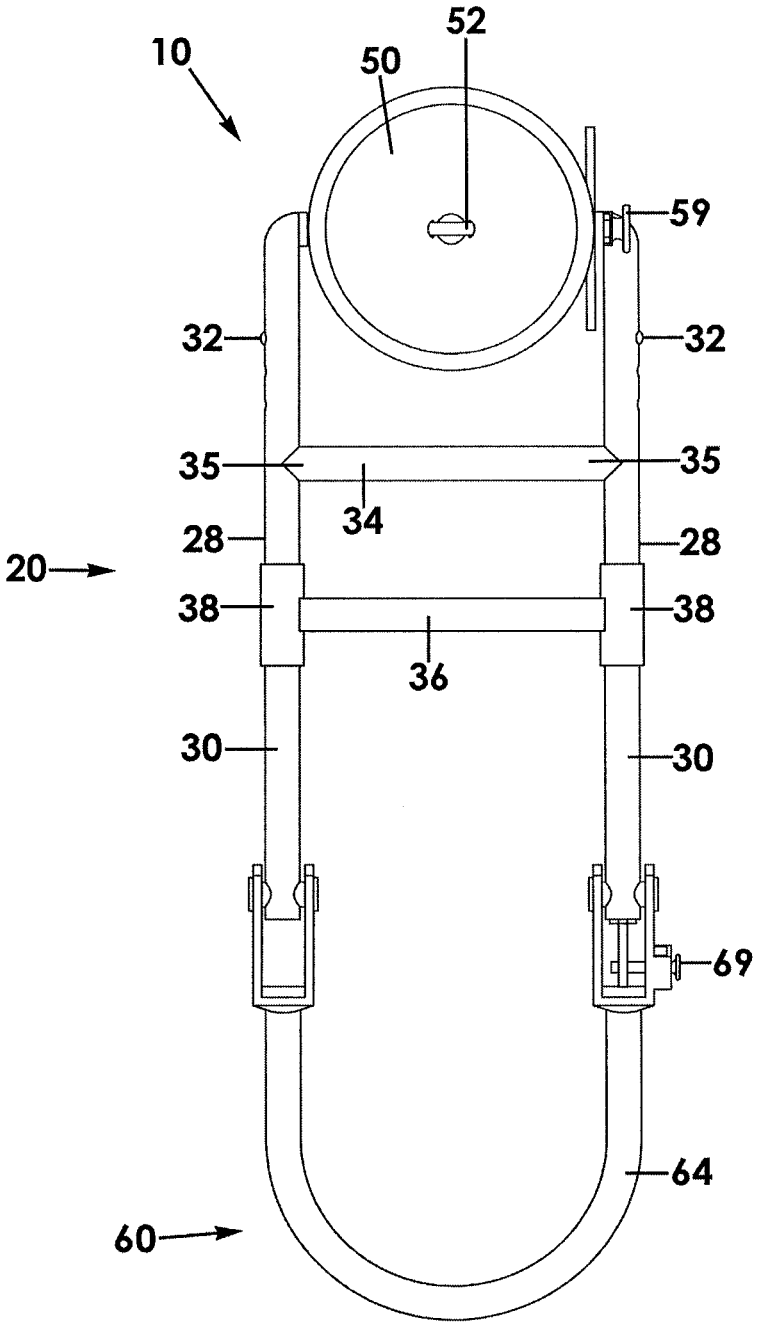
FIG. 7 is a top view of the training device as in FIG. 1.
Figure 8A:
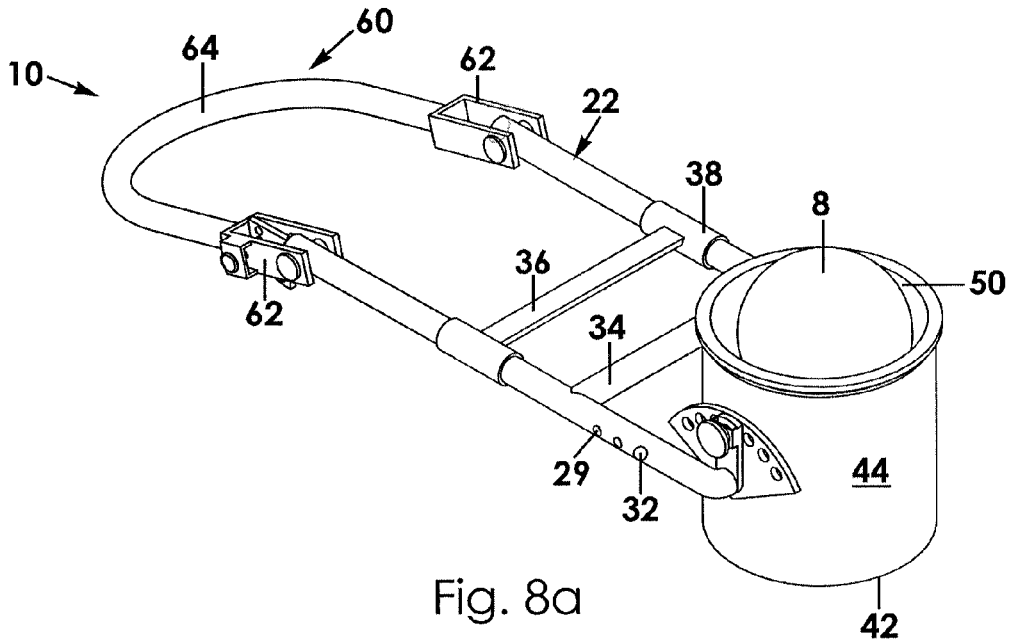
FIG. 8*a* is a perspective view of the training device as in FIG. 1 illustrated with a training ball received in the receptacle.
Figure 8B:
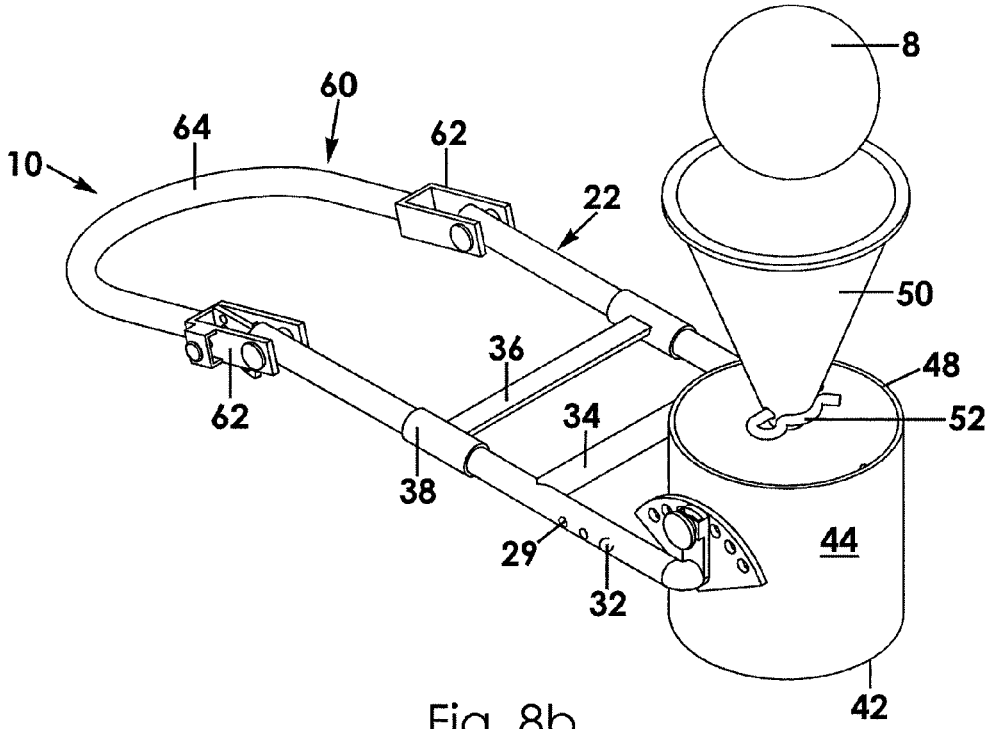
FIG. 8*b* is an exploded view of the training device as in FIG. 8*a*.

In an embodiment, an outer surface of the side wall 44 of the receptacle 40 is pivotally coupled to respective distal end 26 of the pair of frame members 22 such that the receptacle 40 is selectively rotatable. More particularly, the receptacle 40 is selectively rotatable about an imaginary axis defined between the respective distal end 26 of the frame members 22. It is understood that structures such as hubs, pins, or other fasteners or mounting hardware may be utilized in coupling the distal end 26 of the frame members 22 to the side wall 44 of the receptacle 40. It can be seen in the drawings that the open top 48 of the receptacle 40 is offset forwardly or rearwardly when the receptacle 40 is rotated (FIGS. 5 and 6).

A position setting assembly 54 is coupled to a distal end 26 of at least one of the pair of frame members 22, the position setting assembly 54 being configured to selectively hold the receptacle 40 at a selected configuration of rotatable movement about the imaginary axis or to allow such movement. More particularly, the position setting assembly 54 may include a selection plate 56 coupled to the distal end 26 of at least one of the pair of frame members 22. The selection plate 56 defines a plurality of spaced apart apertures 58. The position setting assembly 54 includes a fastener 59 configured to be inserted through a selected aperture 58 so as to secure the receptacle 40 from rotatable movement. As shown in the drawings, rotatable movement of the receptacle 40 selectively offsets the angle of the open top 48 which may be appropriate for use by tall versus short persons, i.e. that a training ball thrown toward the open top 48 is received efficiently into the open area 46. In an embodiment, the fastener 59 is a spring loaded pin that is biased to extend automatically through an aperture 58 and bear against the side wall 44 of the receptacle 40 and, as a result, prevent rotational movement of the receptacle. The selection plate 56 may be sandwiched between the distal end 26 of the frame member 22 and the side wall 44 of the receptacle 40. In use, a user is able to move the selection plate 56 to a desired angle and lock into place, the angle being an offset relative to the horizontal plane defined by the frame members 22. Regarding the selections of the selection plate 56, compare FIGS. 5 and 6.

In an embodiment, each elongate frame member 22 is length adjustable. Each frame member 22 includes a first section 28 having a tubular configuration and a second section 30 having a tubular configuration, the second section 30 being slidably movable a relative distance into or out of the section first section 28 (FIG. 2). More particularly, the second section 30 is movable between a retracted configuration (FIG. 3) a relative distance inside the first section 28 and an extended configuration (FIG. 4) a relative distance outside the first section 28. Clearly, adjustment of the sections changes the distance the handle member 34 is from the receptacle 40. To facilitate the movement and selective positioning, a first fastener 32 is situated on an outer surface of the second section 30. Preferably, the first fastener 32 is a spring loaded pin although other fasteners may also work.

A corresponding first section 28 defines a plurality of spaced apart holes 29 configured to receive the first fastener 32 therethrough so as to hold the respective frame member 22 at a selected adjusted length.

In an embodiment, the training device 10 includes an arm support assembly 60 coupled to proximal ends 24 of the pair of frame members 22, respectively. More particularly, the arm support assembly 60 includes opposed ends 62 having couplings rotatably attached to proximal ends 24 of the pair of frame member 22 (FIG. 1). A conduit 64 having a generally U-shaped configuration extends generally rearwardly of the frame members 22 between the opposed ends 62 (FIG. 1). The arm support assembly 60 is selectively rotatably movable between a primary position co-planar with the plane defined by the pair of frame members 22 and an angularly adjusted configuration that is offset downwardly from the plane. The positional variations that are possible with the arm support assembly 60 can best be understood by comparing FIGS. 3 and 6.

To facilitate the adjustments described above, the arm support assembly 60 may include an arm support selection plate 66 attached to a respective proximal end of a respective frame member 22, the arm support selection plate 66 being situated adjacent a respective opposed end 62 of the arm support assembly 60 (FIGS. 2 and 5). The arm support selection plate 66 defines a plurality of spaced apart apertures 68. The arm support assembly 60 includes a fastener 69 having a configuration that is complementary to a configuration of each of the plurality of apertures 68. Accordingly, the fastener 69 is configured to protrude and extend through a selected aperture 68 and bear against the corresponding opposed end 62 of the arm support assembly 60 (or, specifically, against the coupling structure) so as to prevent rotatable movement thereof.

Figure 9:
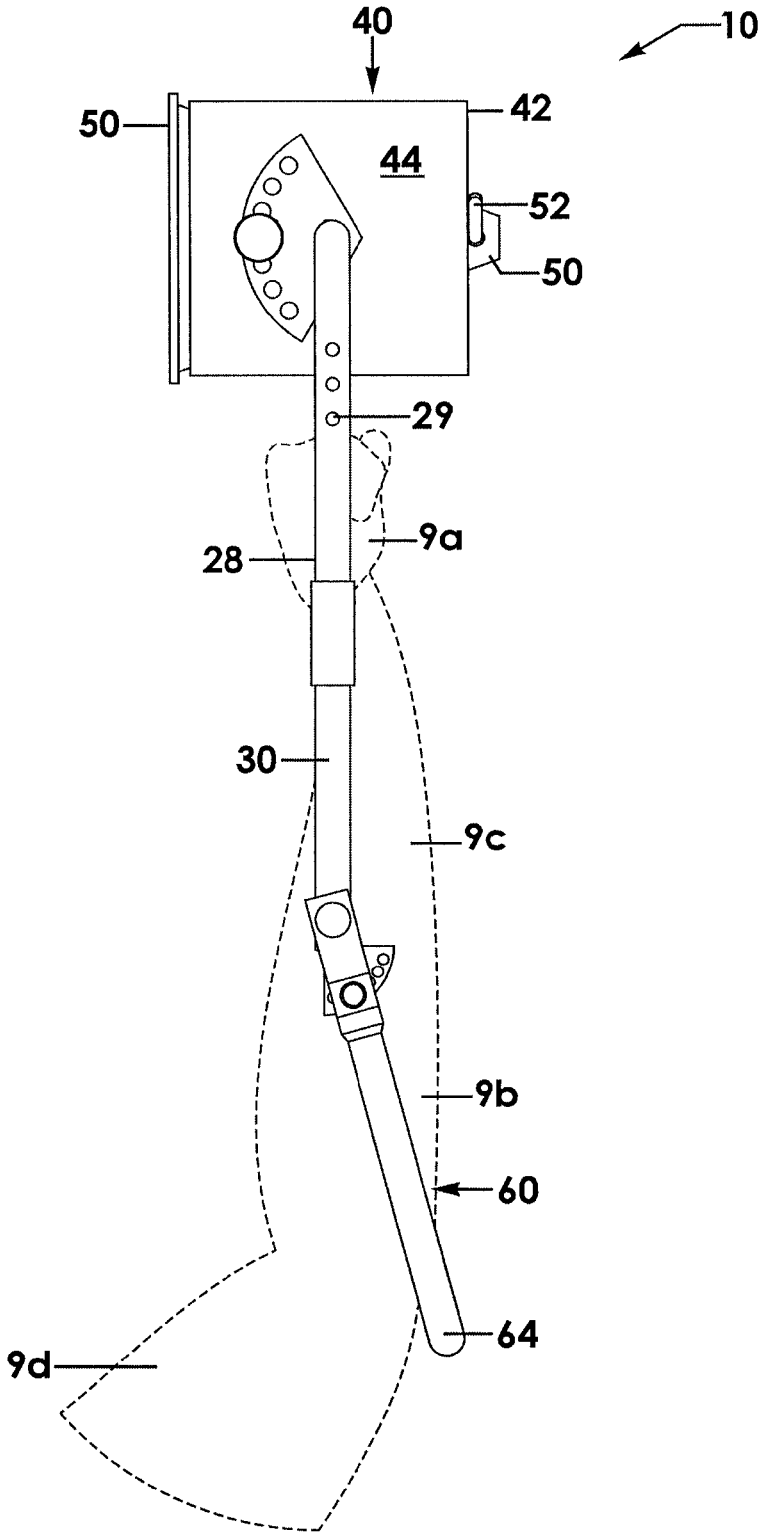
FIG. 9 is a side view of the training device as in FIG. 1 illustrated in use and held by a user.

In use, a person (also referred to as "the user") may grasp the padded handle member 34 with his hand 9*a* in a relaxed neutral grip adjacent the receptacle 40 such that the entire external rotator muscles training device 10 can be held in various positions while performing exercise steps intended to train the external rotators in his shoulder in both eccentric (produces force as the muscle lengthens) and concentric (produces force as the muscle shortens) muscle actions. As shown in FIG. 9, the user initially positions the frame members 22 in a vertical position such that the receptacle 40 is upwardly disposed and with the receptacle 40 rotated with the open top 48 generally directed laterally relative to the user. More particularly, the user raises his arm forwardly parallel to the floor and bends his elbow about 90 degrees so that the forearm 9*c* is perpendicular with the floor. The user's arm 9*b* may rest against the arm support assembly 60.

Then, from a position lateral the user, a partner such as a physical therapist may lightly toss a medicine ball into the receptacle 40 while the user's arm is in the position described above. The momentum of the weighted ball creates an external force that the external rotators have to slow down in an eccentric fashion. Catching the ball traveling in a horizontal force vector creates torque that stimulates the external rotators immediately and throughout the entire range of motion. The user's upper arm 9*d* should remain parallel with the floor and the elbow bent at 90 degrees as the arm rotates at the shoulder until the forearm 9*c* is parallel to the floor (or approaches the user's end range) but perpendicular to the upper arm. Once the forearm is perpendicular to the floor or has reached the end range, the user should immediately and forcefully rotate the arm at the shoulder back to, or beyond, the starting position, thus throwing the ball back to the partner.

Due to the action of the user throwing the ball, the user does not have to use internal rotators to slow the momentum of the added weight in order to prevent over rotating the arm externally. This allows for maximal muscle action through a larger range of motion, allowing a better stimulus of the external rotators while decreasing the chance of momentum forcefully externally rotating the arm at the shoulder. All of these factors combined create an optimum method of training the external rotators of the shoulder.

It is understood that while certain forms of this invention have been illustrated and described, it is not limited thereto except insofar as such limitations are included in the following claims and allowable functional equivalents thereof.

The invention claimed is:

1. An external rotator muscles training device for use with a training ball to strengthen external rotator muscles of a person's shoulder, comprising:

a frame assembly having a pair of elongate frame members displaced from and parallel to one another, each frame member having opposed proximal and distal ends;

a receptacle having a closed bottom and a side wall extending upwardly from said closed bottom, said side wall defining an open top allowing access to an interior area defined by said closed bottom and said side wall;

wherein said receptacle is coupled to said distal ends of said pair of frame members and positioned in a primary position in which said open top is generally perpendicular to a plane defined by said pair of frame members;

a handle member extending between said pair of frame members, said handle member being situated between said receptacle and said proximal ends of said pair of frame members;

a receiving member releasably coupled to said receptacle and positioned in said interior area;

wherein said receiving member includes an upper rim having a diameter substantially similar to a diameter of said open top and includes a side wall having a generally conical configuration adapted to receive the training ball.

2. The external rotator muscles training device as in claim 1, wherein an outer surface of said side wall of said receptacle is pivotally coupled to said distal ends of said pair of frame members and is rotatably movable about an imaginary axis extending between said distal ends.

3. The external rotator muscles training device as in claim 2, wherein said open top of said receptacle is offset forwardly or rearwardly when said receptacle is rotatably moved.

4. The external rotator muscles training device as in claim 2, comprising a position setting assembly coupled to a distal end of at least one of said pair of frame members, said position setting assembly being configured to selectively hold said receptacle at a selected configuration of rotatable movement relative to said imaginary axis or to allow rotatable movement of said receptacle about said imaginary axis.

5. The external rotator muscles training device as in claim 4, wherein said position setting assembly includes:

a selection plate fixedly coupled to said distal end of said at least one frame member, said selection plate sandwiched between said distal end and said side wall of said receptacle;

said selection plate defining a plurality of spaced apart apertures;

a fastener having a configuration complementary to a configuration of said plurality of apertures and configured to selectively extend through a selected aperture and bear against said side wall of said receptacle, whereby to prevent movement of said receptacle about said imaginary axis.

6. The external rotator muscles training device as in claim 5, wherein said fastener is a spring loaded pin.

7. The external rotator muscles training device as in claim 1, further comprising a support arm having opposed ends slidably coupled to respective frame members in a friction fit arrangement, said opposed ends being movable along said respective frame members between said handle member and said proximal ends of said frame members.

8. The external rotator muscles training device as in claim 5, further comprising a support arm having opposed ends slidably coupled to respective frame members in a friction fit arrangement, said opposed ends being movable along said respective frame members between said handle member and said proximal ends of said frame members.

9. The external rotator muscles training device as in claim 1, wherein each frame member is length adjustable.

10. The external rotator muscles training device as in claim 9, wherein:

each frame member includes a tubular first section and a tubular second section slidably received in said first section, said second section being movable between a retracted configuration substantially inside said first section and an extended configuration substantially outside said first section;

said second section includes a fastener situated on an outer surface thereof; and said first section defines a plurality of spaced apart holes, each hole being configured to selectively receive said fastener, whereby to selectively hold said frame member at a selected length.

11. The external rotator muscles training device as in claim 8, wherein:

each frame member includes a tubular first section and a tubular second section slidably received in said first section, said second section being movable between a retracted configuration substantially inside said first section and an extended configuration substantially outside said first section;

said second section includes a fastener situated on an outer surface thereof; and said first section defines a plurality of spaced apart holes, each hole being configured to selectively receive said fastener, whereby to selectively hold said frame member at a selected length.

12. The external rotator muscles training device as in claim 1, further comprising an arm support assembly that includes a pair of opposed ends rotatably coupled to respective proximal ends of said frame assembly and a conduit having a generally U-shaped configuration extending rearwardly between said opposed ends.

13. The external rotator muscles training device as in claim 12, wherein said arm support assembly is movable between a primary position coplanar with said pair of frame members and a position downwardly offset from said plane.

14. The external rotator muscles training device as in claim 13, wherein said arm support assembly includes:

an arm support selection plate fixedly coupled to said proximal end of a respective frame member adjacent a respective opposed end of said arm support assembly;

said arm support selection plate defining a plurality of spaced apart apertures; and a fastener having a configuration complementary to a configuration of said plurality of apertures and configured to selectively extend through a selected aperture and bear against said opposed end of said arm support assembly, whereby to prevent movement of arm support assembly.

15. The external rotator muscles training device as in claim 1, further comprising:

an arm support assembly that includes a pair of opposed ends rotatably coupled to respective proximal ends of said frame assembly and a conduit having a generally U-shaped configuration extending rearwardly between said opposed ends;

wherein said arm support assembly is movable between a primary position coplanar with said pair of frame members and a position downwardly offset from said plane.

16. The external rotator muscles training device as in claim 15, wherein said arm support assembly includes:

an arm support selection plate fixedly coupled to said proximal end of a respective frame member adjacent a respective opposed end of said arm support assembly;

said arm support selection plate defining a plurality of spaced apart apertures; and a fastener having a configuration complementary to a configuration of said plurality of apertures and configured to selectively extend through a selected aperture and bear against said opposed end of said arm support assembly, whereby to prevent movement of arm support assembly.

* * * * *